US011574763B2

(12) United States Patent
Park et al.

(10) Patent No.: US 11,574,763 B2
(45) Date of Patent: Feb. 7, 2023

(54) COIL COMPONENT

(71) Applicant: SAMSUNG ELECTRO-MECHANICS CO., LTD., Suwon-si (KR)

(72) Inventors: Kwang Il Park, Suwon-si (KR); In Suk Kim, Suwon-si (KR); Young Sun Kim, Suwon-si (KR); Sung Hee Kim, Suwon-si (KR); In Young Kang, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 344 days.

(21) Appl. No.: 15/931,161

(22) Filed: May 13, 2020

(65) Prior Publication Data

US 2021/0134509 A1 May 6, 2021

(30) Foreign Application Priority Data

Oct. 30, 2019 (KR) ..... 10-2019-0136189

(51) Int. Cl.
*H01F 27/08* (2006.01)
*H01F 27/29* (2006.01)
(Continued)

(52) U.S. Cl.
CPC ..... *H01F 27/08* (2013.01); *H01F 27/24* (2013.01); *H01F 27/2804* (2013.01);
(Continued)

(58) Field of Classification Search
CPC ..... H01F 27/08; H01F 27/24; H01F 27/2804; H01F 27/29; H01F 41/041; H01F 2027/2809
(Continued)

(56) References Cited

U.S. PATENT DOCUMENTS

2015/0102891 A1 4/2015 Yoon et al.
2018/0315544 A1* 11/2018 Moon ..... H01F 17/04
(Continued)

FOREIGN PATENT DOCUMENTS

CN 104575946 A 4/2015
CN 108074727 A 5/2018
(Continued)

OTHER PUBLICATIONS

Chinese Office Action dated Mar. 9, 2022 , issued in corresponding Chinese Patent Application No. 202010691026.0.
(Continued)

*Primary Examiner* — Suresh Memula
(74) *Attorney, Agent, or Firm* — Morgan, Lewis & Bockius LLP

(57) ABSTRACT

A coil component includes a body having both end surfaces opposing each other in a length direction; a support substrate disposed in the body; a coil portion disposed on the support substrate in a width direction of the body, and including first and second lead-out portions each exposed to a first surface and a second surface of the body opposing each other in a thickness direction of the body, respectively, and disposed on the support substrate; and first and second external electrodes disposed on the first surface of the body, spaced apart from each other, and connected to one ends of the first and second lead-out portions exposed to the first surface of the body, respectively.

20 Claims, 7 Drawing Sheets

(51) Int. Cl.
*H01F 27/28* (2006.01)
*H01F 41/04* (2006.01)
*H01F 27/24* (2006.01)

(52) U.S. Cl.
CPC ..... *H01F 27/29* (2013.01); *H01F 41/041* (2013.01); *H01F 2027/2809* (2013.01)

(58) Field of Classification Search
USPC ..... 336/55
See application file for complete search history.

(56) References Cited

U.S. PATENT DOCUMENTS

| | | | | |
|---|---|---|---|---|
| 2019/0013143 | A1 | 1/2019 | Kim et al. | |
| 2019/0096564 | A1 | 3/2019 | Park et al. | |
| 2019/0326047 | A1* | 10/2019 | Yamaguchi | H01F 27/2804 |
| 2020/0286672 | A1* | 9/2020 | Yang | H01F 27/255 |
| 2020/0294712 | A1* | 9/2020 | Kim | H01F 17/04 |
| 2020/0328023 | A1* | 10/2020 | Kim | H01F 27/292 |
| 2020/0357565 | A1* | 11/2020 | Li | H01F 17/0013 |
| 2021/0027931 | A1* | 1/2021 | Yang | H01F 27/2804 |
| 2021/0050140 | A1* | 2/2021 | Ryu | H01F 27/324 |

FOREIGN PATENT DOCUMENTS

| | | | | |
|---|---|---|---|---|
| CN | 109215973 | A | 1/2019 | |
| CN | 109559874 | A | 4/2019 | |
| KR | 10-2014-0038780 | A | 3/2014 | |
| KR | 10-2018-0054253 | A | 5/2018 | |
| KR | 20220039470 | A * | 3/2022 | |
| WO | WO-2008026771 | A1 * | 3/2008 | H02K 15/0407 |

OTHER PUBLICATIONS

Chinese Office Action dated Jun. 21, 2022, issued in corresponding Chinese Patent Application No. 202010691026.0 (with English translation).

* cited by examiner

COIL COMPONENT

CROSS-REFERENCE TO RELATED APPLICATION(S)

The present application claims the benefit of priority to Korean Patent Application No. 10-2019-0136189 filed on Oct. 30, 2019 in the Korean Intellectual Property Office, the disclosure of which is incorporated herein by reference in its entirety.

TECHNICAL FIELD

The present disclosure relates to a coil component.

BACKGROUND

An inductor, a coil component, is a representative passive electronic component used in electronic devices together with a resistor and a capacitor.

As an electronic device has been designed to have high performance and a reduced size, the number of coil components used in an electronic device has been increased, and the sizes of coil components have been reduced.

Even when a coil component has a reduced size, to secure properties of a coil component, such as inductance and a quality factor, it may be necessary to secure volumes of a magnetic material and a coil portion.

Further, it may be necessary to improve heat dissipation properties in terms of properties of a coil component.

SUMMARY

An aspect of the present disclosure is to provide a coil component which may have a reduced mounting area while volumes of a magnetic material and a coil portion are maintained.

Another aspect of the present disclosure is to provide a coil component which may have improved heat dissipation properties.

According to an aspect of the present disclosure, a coil component includes a body having a width greater than a thickness thereof, and having both end surfaces opposing each other in a length direction; a support substrate buried in the body; a coil portion including first and second lead-out portions exposed to one surface and the other surface of the body opposing each other in a thickness direction of the body, respectively, and disposed on the support substrate; and first and second external electrodes disposed on the one surface of the body, spaced apart from each other, and connected to one ends of the first and second lead-out portions exposed to the one surface of the body, respectively.

According to another aspect of the present disclosure, a coil component includes a body having first and second surfaces opposing each other in a thickness direction, third and fourth surfaces opposing each other in a width direction and connecting the first and second surfaces to each other, and fifth and sixth surfaces opposing each other in a length direction and connecting the first and second surfaces to each other and the third and fourth surfaces to each other; a support substrate disposed in the body; a coil portion disposed on the support substrate in the width direction, and including first and second lead-out portions each extending in an opposite manner in the length direction, wherein each of the first and second lead-out portions includes two ends respectively extending in an opposite manner in the thickness direction to be exposed to the first and second surfaces, respectively; and first and second external electrodes disposed on the first surface of the body, spaced apart from each other, and respectively connected to one ends of the first and second lead-out portions exposed to the first surface of the body.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
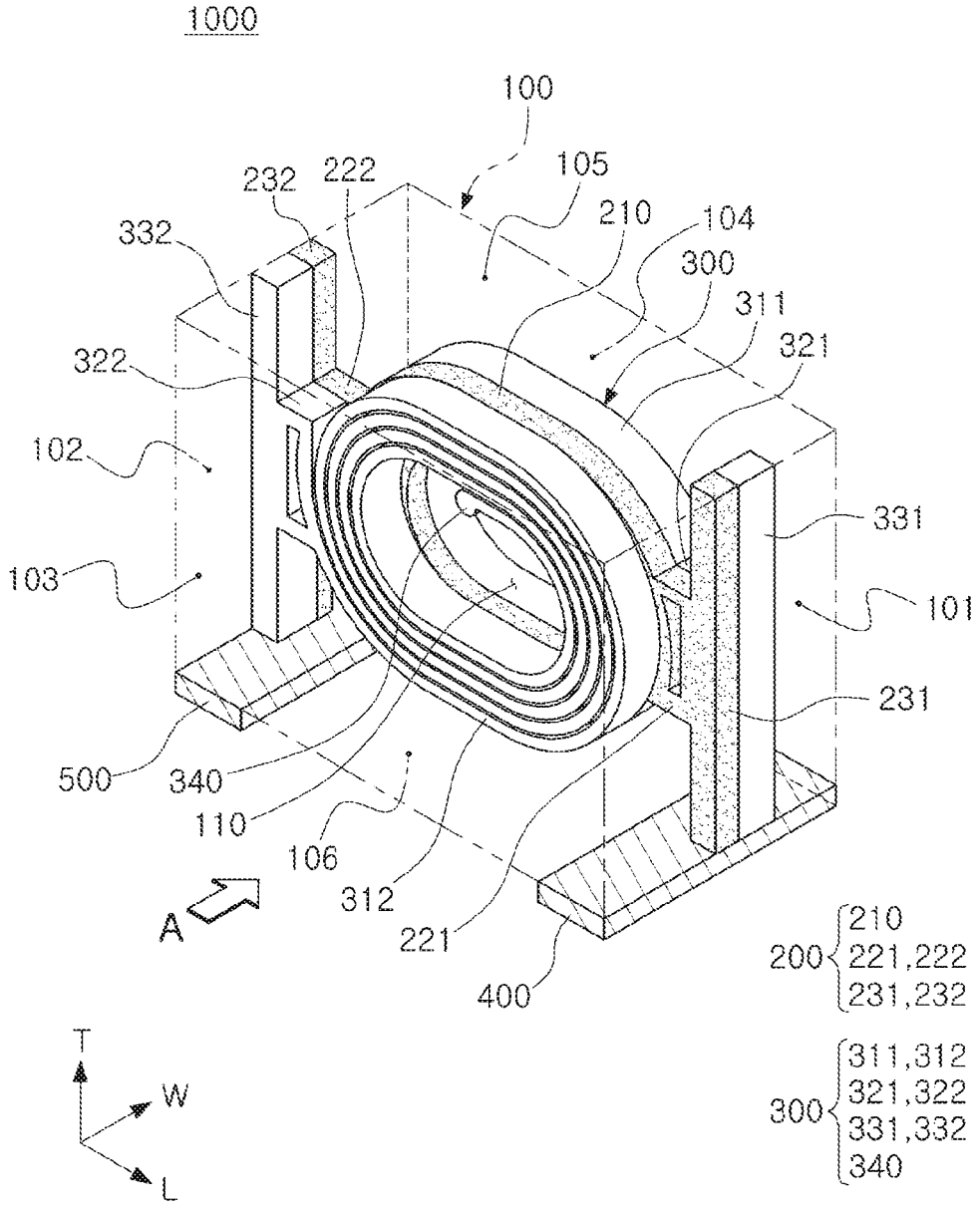
FIG. 1 is a diagram illustrating a coil component according to an exemplary embodiment of the present disclosure.

Hereinafter, embodiments of the present disclosure will be described as follows with reference to the attached drawings.

The terms used in the exemplary embodiments are used to simply describe an exemplary embodiment, and are not intended to limit the present disclosure. A singular term includes a plural form unless otherwise indicated. The terms, "include," "comprise," "is configured to," etc. of the description are used to indicate the presence of features, numbers, steps, operations, elements, parts or combination thereof, and do not exclude the possibilities of combination or addition of one or more features, numbers, steps, operations, elements, parts or combination thereof. Also, the term "disposed on," "positioned on," and the like, may indicate that an element is positioned on or beneath an object, and does not necessarily mean that the element is positioned on the object with reference to a gravity direction.

The term "coupled to," "combined to," and the like, may not only indicate that elements are directly and physically in contact with each other, but also include the configuration in which the other element is interposed between the elements such that the elements are also in contact with the other component.

Sizes and thicknesses of elements illustrated in the drawings are indicated as examples for ease of description, and exemplary embodiments in the present disclosure are not limited thereto.

In the drawings, an L direction is a first direction or a length direction, a W direction is a second direction or a width direction, a T direction is a third direction or a thickness direction.

In the descriptions described with reference to the accompanied drawings, the same elements or elements corresponding to each other will be described using the same reference numerals, and overlapped descriptions will not be repeated.

In electronic devices, various types of electronic components may be used, and various types of coil components may be used between the electronic components to remove noise, or for other purposes.

In other words, in electronic devices, a coil component may be used as a power inductor, a high frequency inductor, a general bead, a high frequency bead, a common mode filter, and the like.

Embodiment and Modified Examples Thereof

Figure 2:
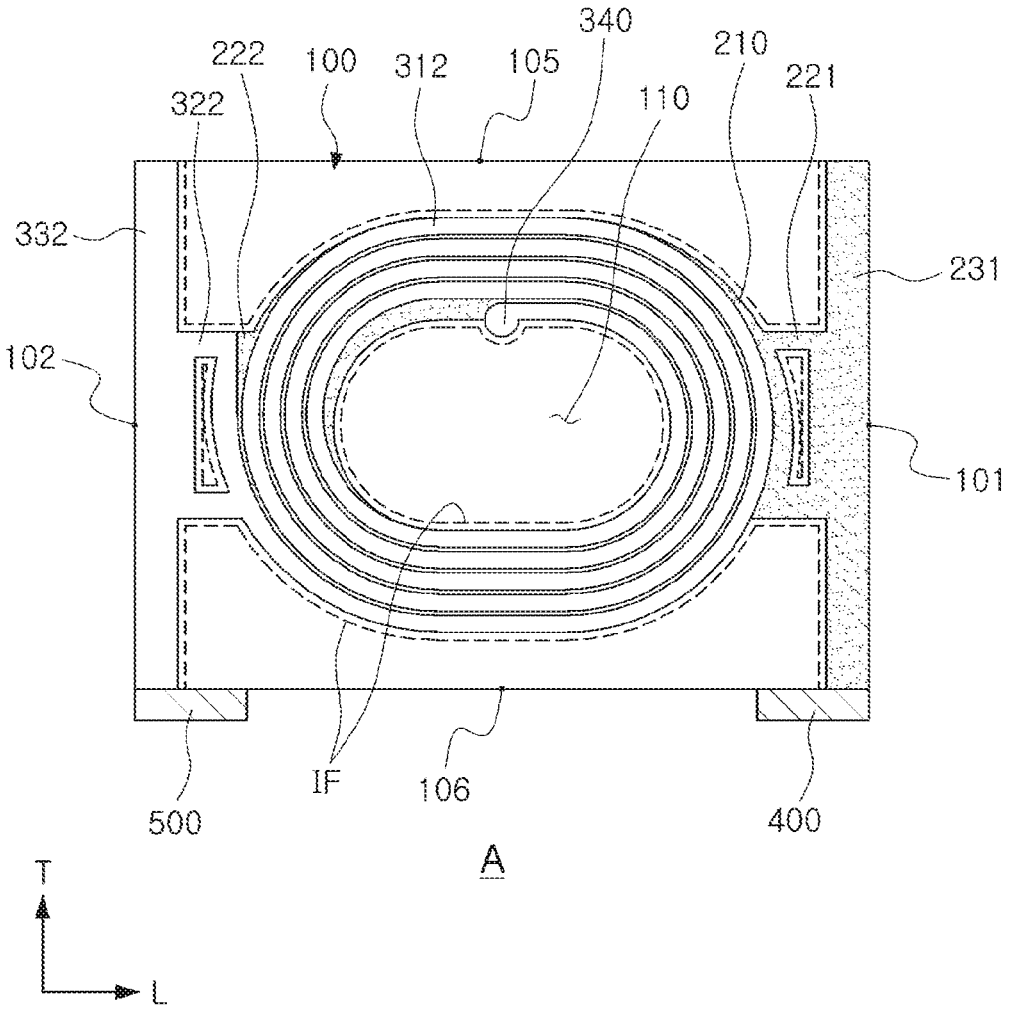
FIG. 2 is a diagram illustrating the coil component illustrated in FIG. 1, viewed in direction A.
Figure 3A:
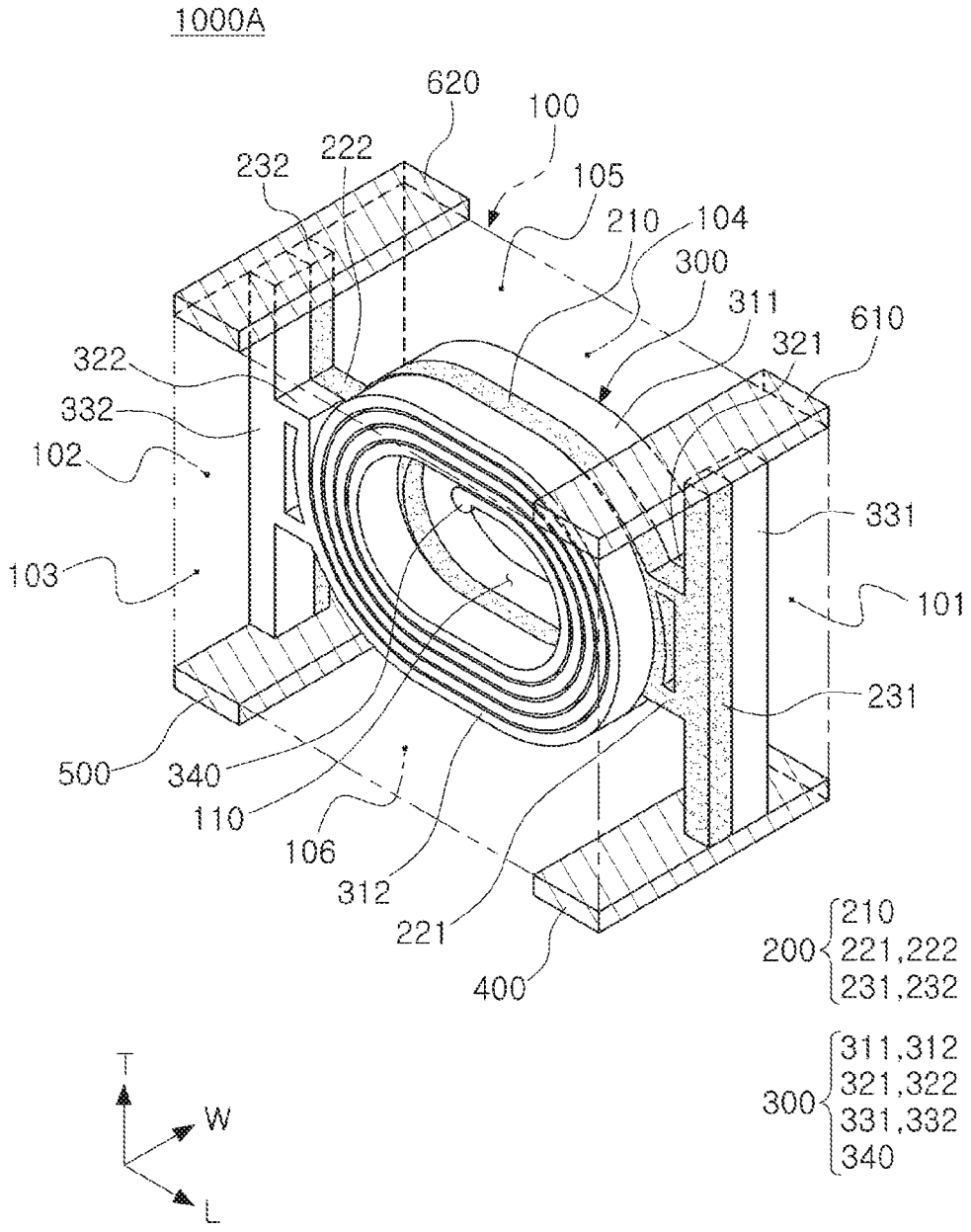
FIGS. 3A, 3B, and 3C are diagrams illustrating modified examples of a coil component according to an exemplary embodiment of the present disclosure.
Figure 3B:
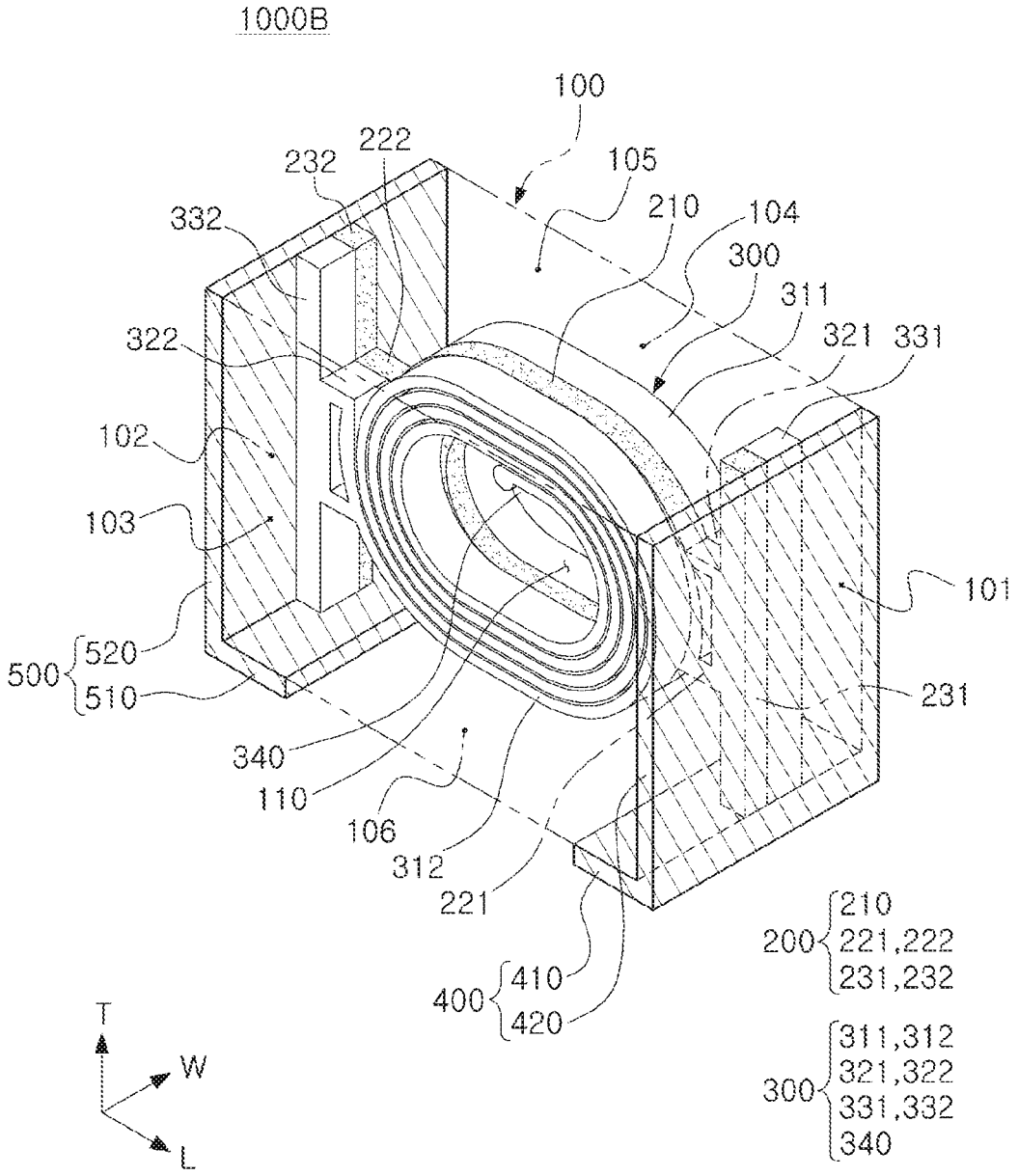
Figure 3C:
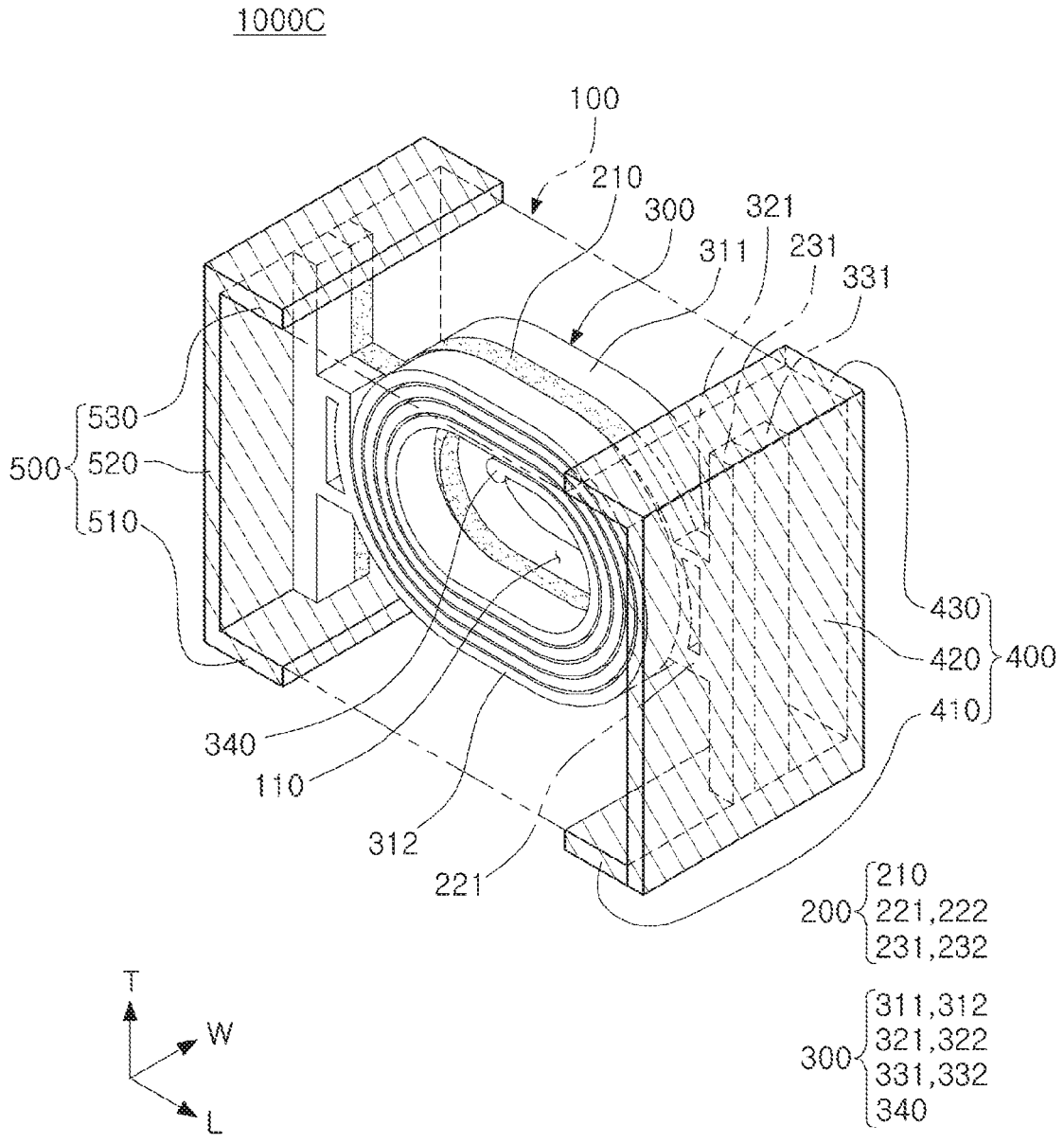

FIG. 1 is a diagram illustrating a coil component according to an exemplary embodiment. FIG. 2 is a diagram illustrating the coil component illustrated in FIG. 1, viewed in direction A. FIGS. 3A, 3B, and 3C are diagrams illustrating modified examples of a coil component according to an exemplary embodiment.

Referring to FIGS. 1 to 3C, a coil component 1000 in the exemplary embodiment may include a body 100, a support substrate 200, a coil portion 300, and external electrodes 400 and 500, and may further include an insulating film IF.

The body 100 may form an exterior of the coil component 1000 in the exemplary embodiment, and the coil portion 300 may be buried in the body 100.

The body 100 may have a hexahedral shape.

As illustrated in FIGS. 1, 3A, 3B, and 3C, the body 100 may include a first surface 106 and a second surface 105 opposing each other in a thickness direction T, a third surface 103 and a fourth surface 104 opposing each other in a width direction W, and a fifth surface 101 and a sixth surface 102 opposing each other in a length direction L. The third to sixth surfaces 103, 104, 101, and 102 of the body 100 may be walls of the body 100 connecting the first surface 106 and the second surface 105 of the body 100 to each other. In the description below, "two end surfaces of the body" may refer to the fifth surface 101 and the sixth surface 102, and "side surfaces of the body" may refer to the third surface 103 and the fourth surface 104 of the body. Also, "one surface and another surface" of the body 100 may refer to the first surface 106 and the second surface 105 of the body 100. When the coil component 1000 is mounted on a mount substrate such as printed circuit board, the one surface 106 of the body 100 may be disposed to be directed to a mounting surface of the mount substrate.

The body 100 may have a thickness, a size of which is greater than a size of a width. For example, the body 100 may have a length of 1.0 mm, a width of 0.6 mm, and a thickness of 0.8 mm, but an exemplary embodiment thereof is not limited thereto. The above-mentioned sizes are example sizes determined without consideration of a process error, and the like, and an example of the sizes is not limited thereto.

The body 100 may include a magnetic material and a resin material. For example, the body 110 may be formed by layering one or more magnetic composite sheets including a resin and a magnetic material dispersed in a resin. Alternatively, the body 100 may have a structure different from the structure in which a magnetic material is dispersed in a resin. For example, the body 100 may be formed of a magnetic material such as ferrite.

The magnetic material may be ferrite or a magnetic metal powder.

The ferrite may include, for example, one or more materials of a spinel ferrite such as an Mg—Zn ferrite, an Mn—Zn ferrite, an Mn—Mg ferrite, a Cu—Zn ferrite, an Mg—Mn—Sr ferrite, an Ni—Zn ferrite, and the like, a hexagonal ferrite such as a Ba—Zn ferrite, a Ba—Mg ferrite, a Ba—Ni ferrite, a Ba—Co ferrite, a Ba—Ni—Co ferrite, and the like, a garnet ferrite such as a Y ferrite, and a Li ferrite.

The magnetic metal powder may include one or more selected from a group consisting of iron (Fe), silicon (Si), chromium (Cr), cobalt (Co), molybdenum (Mo), aluminum (Al), niobium (Nb), copper (Cu), and nickel (Ni). For example, the magnetic metal powder may be one or more of a pure iron powder, a Fe—Si alloy powder, a Fe—Si—Al alloy powder, a Fe—Ni alloy powder, a Fe—Ni—Mo alloy powder, Fe—Ni—Mo—Cu alloy powder, a Fe—Co alloy powder, a Fe—Ni—Co alloy powder, a Fe—Cr alloy powder, a Fe—Cr—Si alloy powder, a Fe—Si—Cu—Nb alloy powder, a Fe—Ni—Cr alloy powder, and a Fe—Cr—Al alloy powder.

The magnetic metal powder may be amorphous or crystalline. For example, the magnetic metal powder may be a Fe—Si—B—Cr amorphous alloy powder, but an exemplary embodiment of the magnetic metal powder is not limited thereto.

Each particle of the ferrite and the magnetic metal powder may have an average diameter of 0.1 μm to 30 μm, but an example of the average diameter is not limited thereto.

The body 100 may include two or more types of magnetic materials dispersed in a resin. The notion that types of the magnetic materials are different may indicate that one of an average diameter, a composition, crystallinity, and a form of a magnetic material disposed in a resin is different from those of the other magnetic material(s).

The resin may include one of an epoxy, a polyimide, a liquid crystal polymer, or mixture thereof, but the example of the resin is not limited thereto.

The body 100 may include a core 110 penetrating the coil portion 300 and the support substrate 200. The core 110 may be formed by filling a through-hole of the coil portion 300 with a magnetic composite sheet, but an exemplary embodiment thereof is not limited thereto.

The support substrate 200 may be buried in the body 100. For example, the support substrate 200 may be buried in the body 100 such that both surfaces of the support substrate 200 on each of which the coil portion 300 is disposed may be perpendicular to the one surface 106 of the body 100. The support substrate 200 may include a support portion 210, connection portions 221 and 222, and end portions 231 and 232, and may support coil patterns 311 and 312, connection patterns 321 and 322, and lead-out portions 331 and 332 of the coil portion 300, respectively. By forming the support portion 210, the connection portions 221 and 222, and the end portions 231 and 232 by processing a single insulating material, the support portion 210, the connection portions 221 and 222, and the end portions 231 and 232 may be integrated with one another without a boundary among the support portion 210, the connection portions 221 and 222, and the end portions 231 and 232.

The support substrate 200 may be formed of an insulating material including a thermosetting insulating resin such as an epoxy resin, a thermoplastic insulating resin such as a polyimide, or a photosensitive insulating resin, or may be formed of an insulating material including a reinforcing material such as a glass fiber or an inorganic filler with the above-described insulating resin. For example, the support substrate 200 may be formed of a material such as prepreg, Ajinomoto Build-up Film (ABF), FR-4, a bismaleimide triazine (BT) resin, a photoimageable dielectric (PID), a copper clad laminate (CCL) and the like, but an example of the material of the internal insulating layer is not limited thereto.

As an inorganic filler, one or more materials selected from a group consisting of silica ($SiO_2$), alumina ($Al_2O_3$), silicon carbide (SiC), barium sulfate ($BaSO_4$), talc, mud, a mica powder, aluminum hydroxide ($Al(OH)_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$), and calcium zirconate ($CaZrO_3$) may be used.

When the support substrate 200 is formed of an insulating material including a reinforcing material, the support substrate 200 may provide improved stiffness. When the support substrate 200 is formed of an insulating material which does not include a glass fiber, the support substrate 200 may be desirable to reducing an overall thickness of the coil portion 300.

The coil portion 300 may be disposed on the support substrate 200. The coil portion 300 may be buried in the body 100 and may exhibit properties of a coil component. For example, when the coil component 1000 is used as a power inductor, the coil portion 300 may store an electrical field as a magnetic field and may maintain an output voltage, thereby stabilizing power of an electronic device.

The coil portion 300 may be formed on at least one of both surfaces of the support substrate 200, and may format least one turn. The coil portion 300 may be disposed on one surface and the other surface of the support substrate 200 facing each other in the width direction W. For example, in the exemplary embodiment, the coil portion 300 may include the coil patterns 311 and 312, the connection patterns 321 and 322, the lead-out portions 331 and 332, and a via. The coil patterns 311 and 312 may be disposed on the one surface and the other surface of the support portion 210 facing each other in the width direction W, the first connection pattern 321 and the first lead-out portion 331 may be disposed on the other surfaces of the first connection portion 221 and the first end portion 231, respectively. The second connection pattern 322 and the second lead-out portion 332 may be disposed on one surfaces of the second connection portion 222 and the second end portion 232, respectively. The via 340 may penetrate the support portion 210 to connect the first and second coil patterns 311 and 312 to each other.

Each of the first coil pattern 311 and the second coil pattern 312 may have a planar spiral shape forming at least one turn with reference to the core 110 of the body 100 as a shaft. As an exemplary embodiment, the first coil pattern 311 may form at least one turn in the direction illustrated in FIG. 1 with reference to the core 110 as a shaft on a rear surface of the support substrate 200. The second coil pattern 312 may format least one turn with reference to the core 110 as a shaft on a front surface of the support substrate 200.

The first and second lead-out portions 331 and 332 may be exposed to the one surface 106 and the other surface 105 of the body 100 opposing each other in a thickness direction T of the body 100. For example, the first lead-out portion 331 may be disposed on the other surface of the first end portion 231 and may be buried in the body 100, and one end and the other end of the first lead-out portion 331 opposing each other in the thickness direction T may be exposed to the one surface 106 and the other surface 105 of the body 100, respectively. The second lead-out portion 332 may be disposed one surface of the second end portion 232 and may be buried in the body 100, and one end and the other end of the second lead-out portion 332 opposing each other in the thickness direction T may be exposed to the one surface 106 and the other surface 105 of the body 100, respectively. One ends of the first and second lead-out portions 331 and 332 may be in contact with and connected to the external electrodes 400 and 500 disposed on the one surface 106 of the body 100 and spaced apart from each other. As both ends of the lead-out portions 331 and 332 are exposed to a surface of the body 100, heat dissipation efficiency of the coil component 1000 in the exemplary embodiment may increase. Also, in the exemplary embodiment, as a thickness of the body 100 is greater than a width of the body 100, and heat may be emitted to an upper surface (a fifth surface) of the body 100, heat transferred to the other components adjacently mounted may be reduced.

The first and second lead-out portions 331 and 332 may penetrate the body 100 in the thickness direction T of the body. For example, the first lead-out portion 331 may be configured to extend from one end of the body 100 exposed to the sixth surface 106 of the body 100 to the other surface 105 of the body 100 in the body 100. The second lead-out portion 332 may be configured to extend from one end of the body 100 exposed to the one surface 106 of the body 100 to the other end exposed to the other surface 105 of the body 100. As the first and second lead-out portions 331 and 332 are configured to penetrate the body 100, a volume of the first and second lead-out portions 331 and 332 having higher thermal conductivity against a total volume of the body 100 may increase such that heat may be emitted efficiently. Also, a heat emission path may be reduced such that heat dissipation efficiency may increase.

The first and second lead-out portions 331 and 332 may be exposed to the two end surfaces 101 and 102 of the body 100. Accordingly, the first lead-out portion 331 may be exposed to the one surface 106 and the other surface 105 of the body 100 and also to the one end surface 101 of the body 100. Also, the second lead-out portion 332 may be exposed to the one surface 106 and the other surface 105 of the body 100 and also to the other end surface 102 of the body 100. As the first and second lead-out portions 331 and 332 are further exposed to the two end surfaces 101 and 102 of the body 100, heat dissipation efficiency may increase.

The connection patterns 321 and 322 may connect the both ends of the coil patterns 311 and 312 to the first and second lead-out portions 331 and 332, respectively.

A bonding reinforcement groove may be formed in each of the first and second connection patterns 321 and 322 such that each of the first and second connection patterns 321 and 322 may include a plurality of connection patterns spaced apart from each other. The first connection pattern 321 may include a plurality of connection patterns spaced apart from each other, and the second connection pattern 322 may include a plurality of connection patterns spaced apart from each other. As each of the first and second connection patterns 321 and 322 includes a plurality of connection patterns, bonding reliability between the coil patterns 311 and 312 and the lead-out portions 331 and 332 may improve. Accordingly, even when one of the plurality of connection patterns 321 and 322 does not connect the coil patterns 311 and 312 to the lead-out portions 331 and 332 due to stress or tolerance, the coil patterns 311 and 312 may be connected to the lead-out portions 331 and 332 through the other connection patterns 321 and 322. As the plurality of connection patterns 321 and 322 are spaced apart from each other, a space formed between the connection patterns 321 and 322 spaced apart from each other may be filled with a magnetic composite material for forming the body 100. Accordingly, bonding force between the body 100 and the coil portion 300 may improve.

The first coil pattern 311, the first connection pattern 321, and the first lead-out portion 331 may be formed together in the same process such that a boundary may be formed among the first coil pattern 311, the first connection pattern 321, and the first lead-out portion 331, and the first coil pattern 311, the first connection pattern 321, and the first lead-out portion 331 may be integrated with one another. The second coil pattern 312, the second connection pattern 322, and the second lead-out portion 332 may be formed together in the same process such that a boundary may be formed among the second coil pattern 312, the second connection pattern 322, and the second lead-out portion 332 and the second coil pattern 312, the second connection pattern 322, and the second lead-out portion 332 may be integrated with one another. However, an exemplary embodiment thereof is not limited thereto. The above-mentioned elements may be formed in different processes and a boundary may be formed among the elements.

At least one of the coil patterns 311 and 312, the connection patterns 321 and 322, the lead-out portions 331 and 332, and a via 340 may include one or more conductive layers.

As an example, when the first coil pattern 311, the first connection pattern 321, the first lead-out portion 331, and the via 340 are formed on a rear surface (in FIG. 1) of the support substrate 200 by a plating process, each of the first coil pattern 311, the first connection pattern 321, the first lead-out portion 331, and the via 340 may include a seed layer and an electrolytic plating layer. The seed layer may be formed by an electroless plating method or a vapor deposition method such as a sputtering method. Each of the seed layer and the electrolytic plating layer may have a single layer structure or a multilayer structure. The electroplating layer having a multilayer structure may be formed in conformal film structure in which an electroplating layer is covered by another electroplating layer, or a structure in which an electroplating layer is only layered on one surface of one of the electroplating layers. A seed layer of the first coil pattern 311 and a seed layer of the via 340 may be integrated with each other such that a boundary may not be formed therebetween, but an exemplary embodiment thereof is not limited thereto. An electroplating layer of the first coil pattern 311 and an electroplating layer of the via 340 may be integrated with each other, such that a boundary may not be formed therebetween, but an exemplary embodiment thereof is not limited thereto.

The coil patterns 311 and 312, the connection patterns 321 and 322, the lead-out portions 331 and 332, and the via 340 may include a conductive material such as copper (Cu), aluminum (Al), silver (Ag), tin (Sn), gold (Au), nickel (Ni), lead (Pb), titanium (Ti), chromium (Cr), molybdenum (Mo), or alloys thereof, but an example of the material is not limited thereto.

In an exemplary embodiment, as the coil portion 300 is perpendicularly disposed on the one surface 106 of the body 100, which is a mounting surface, a mounting area may decrease while a volume of a magnetic material and the coil portion 300 are maintained. Accordingly, a greater number of electronic components may be mounted on a mount substrate having the same area. Also, in the exemplary embodiment, as the coil portion 300 is disposed perpendicularly on the one surface 106 of the body 100, the mounting surface, a direction of a magnetic flux induced by the coil portion 300 in the core 110 may be disposed in parallel to the one surface 106 of the body 100. Accordingly, noise induced to the mounting surface of the mount substrate by the coil portion 300 may be relatively reduced.

The external electrodes 400 and 500 may be disposed on the one surface 106 of the body 100, may be spaced apart from each other, and may be in contact with and connected to ends of the first and second lead-out portions 331 and 332, respectively. The first external electrode 400 may be in contact with and connected to one end of the first lead-out portion 331, and the second external electrode 500 may be in contact with connected to one end of the second lead-out portion 332.

The external electrodes 400 and 500 may electrically connect the coil component 1000 to a printed circuit board, or the like, when the coil component 1000 is mounted on the printed circuit board. As an example, the coil component 1000 in the exemplary embodiment may be mounted such that the one surface 106 of the body 100 may be directed to an upper surface of the printed circuit board. As the external electrodes 400 and 500 are spaced apart from each other on the one surface 106 of the body 100, a connection portion of the printed circuit board may be electrically connected.

The external electrodes 400 and 500 may include at least one of a conductive resin layer and an electrolytic plating layer. The conductive resin layer may be formed by printing a conductive paste on a surface of the body 100. The conductive paste may include at least one or more conductive metals selected from a group consisting of copper (Cu), nickel (Ni), and silver (Ag) and a thermosetting region. The electrolytic plating layer may include one or more elements selected from a group consisting of nickel (Ni), copper (Cu), and tin (Sn).

Referring to FIG. 3A, a coil component 1000A may further include first and second heat dissipation portions 610 and 620 disposed on the other surface 105 of the body 100, spaced apart from each other, and in contact with the other ends of the first and second lead-out portions 331 and 332 exposed the other surface 105 of the body 100, respectively. The first and second heat dissipation portions 610 and 620 may include a conductive metal, and each of the first and second heat dissipation portions 610 and 620 may have an area greater than an exposed area of each of the first and second lead-out portions 331 and 332. Accordingly, heat transferred to the other end of each of the first and second lead-out portions 331 and 332 may be effectively emitted due to a relatively large area of each of the first and second heat dissipation portions 610 and 620. The first and second heat dissipation portions 610 and 620 may be formed together with the external electrodes 400 and 500 in a process of forming the external electrodes 400 and 500. Accordingly, the external electrodes 400 and 500 and the first and second heat dissipation portions 610 and 620 may include the same material, and may have the same structure. As an example, when the external electrodes 400 and 500 are configured to have a three-layered structure including a copper plated layer, a nickel plated layer, and a tin plated layer, the first and second heat dissipation portions 610 and 620 may also have a three-layered structure including a copper plated layer, a nickel plated layer, and a tin plated layer.

Referring to FIGS. 3B and 3C, the external electrodes 400 and 500 in other exemplary embodiments may be modified to have various shapes.

As an example, referring to FIG. 3B, external electrodes 400 and 500 applied to a coil component 1000B in a second exemplary embodiment may be configured to extend from one surface 106 of the body 100 to two end surfaces 101 and 102 of a body 100. The first external electrode 400 may include a first connection portion 410 disposed on the one surface 106 of the body 100 and in contact with and connected to one end of a first lead-out portion 331, and a first extension portion 420 extending from the first connection portion 410 to a first surface 101 of the body 100. The second external electrode 500 may include a second connection portion 510 disposed on a sixth surface 106 of the body 100 and in contact with and connected to a second lead-out portion 332, and a second extension portion 520 extending from the second connection portion 510 to a second surface 102 of the body 100. In the exemplary embodiment, as the first and second lead-out portions 331 and 332 are also exposed to the first and second surfaces 101 and 102 of the body 100, the first and second extension portions 420 and 520 may also be in contact with and connected to the first and second lead-out portions 331 and 332.

As another example, referring to FIG. 3C, external electrodes 400 and 500 applied to a coil component 1000C in a third exemplary embodiment may further extend from two end surfaces 101 and 102 of the body 100 to the other surface 105 of the body 100. The first external electrode 400 may include a first connection portion 410 disposed on the one surface 106 of the body 100 and in contact with and connected to one end of a first lead-out portion 331, a first extension portion 420 extending from the first connection portion 410 to a first surface 101 of the body 100, and a first band portion 430 extending from the first extension portion 420 to a fifth surface 105 of the body 100. The second external electrode 500 may include a second connection portion 510 disposed on a sixth surface 106 of the body 100 and in contact with and connected to a second lead-out portion 332, a second extension portion 520 extending from the second connection portion 510 to a second surface 102 of the body 100, and a second band portion 530 extending from the second extension portion 520 to the fifth surface 105 of the body 100. In the exemplary embodiment, as the first and second lead-out portions 331 and 332 are also exposed to the first and second surfaces 101 and 102 of the body 100, the first and second extension portions 420 and 520 may also be in contact with and connected to the first and second lead-out portions 331 and 332. Also, as the other ends of the first and second lead-out portions 331 and 332 are also exposed to the fifth surface 105 of the body 100, the first and second band portions 430 and 530 may also in contact with and connected to the first lead-out portion 331.

In the aforementioned exemplary embodiments, as bonding force between the lead-out portions 331 and 332 and the external electrodes 400 and 500 increases, bonding force between the body 100 and the external electrodes 400 and 500 may increase. Also, as each of the external electrodes 400 and 500 is disposed in an area greater than an exposed surface of each of the lead-out portions 331 and 332, heat dissipation efficiency may increase.

An insulating film IF may be disposed between the support substrate 200 and the coil portion 300 and the body 100. The insulating film IF may include a generally used insulating material such as parylene, or the like. The insulating material included in the insulating film IF may not be limited to any particular insulating material. The insulating film IF may be formed by a vapor deposition method, or the like, but an example of the method is not limited thereto. The insulating film IF may also be formed by layering an insulating film on both surfaces of the support substrate 200. The insulating film IF may be omitted provided that insulating resistance between the body 100 and the coil portion 300 are sufficiently secured while the coil component 1000 is used.

Further Exemplary Embodiment

Figure 4:
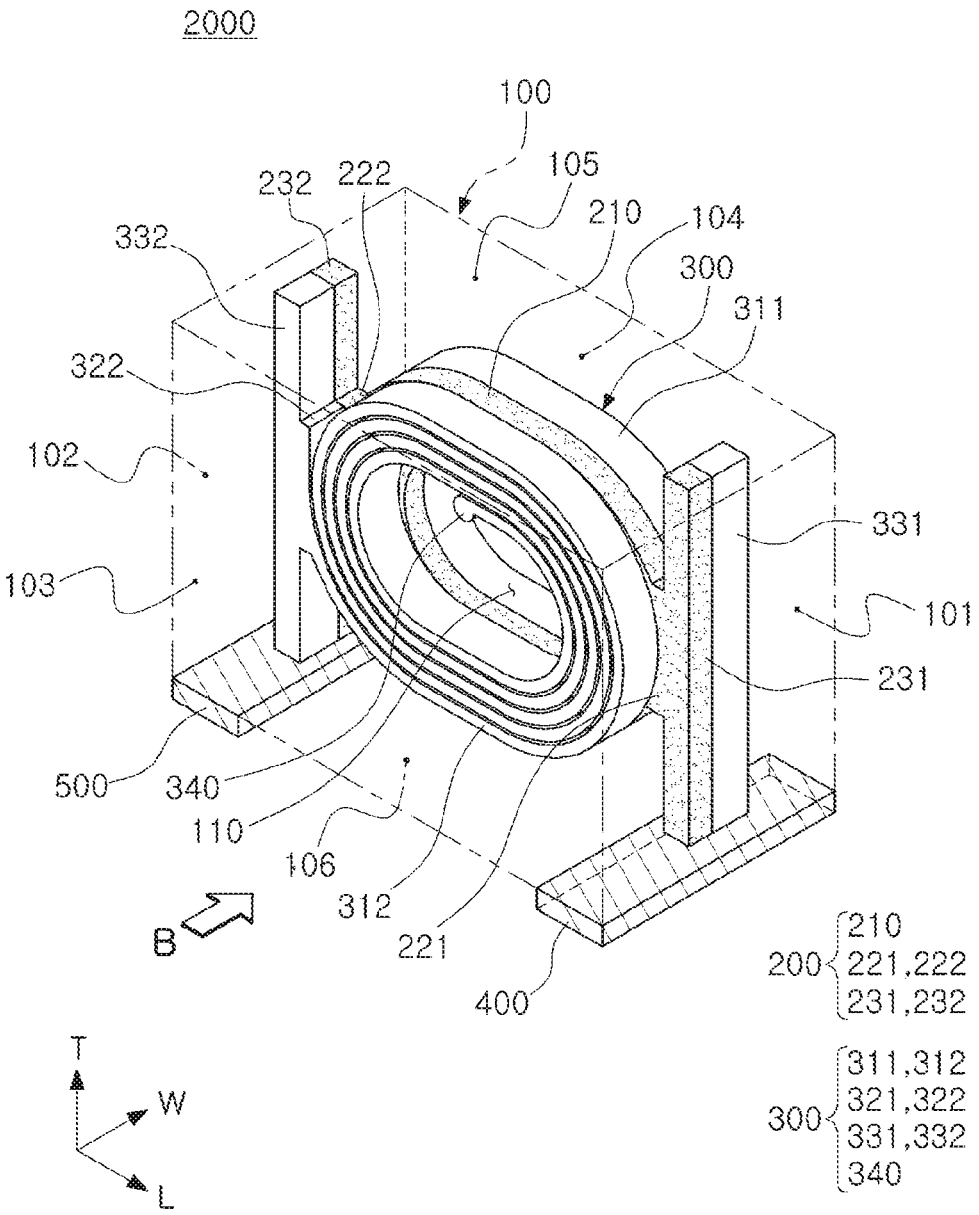
FIG. 4 is a diagram illustrating a coil component according to another exemplary embodiment of the present disclosure.
Figure 5:
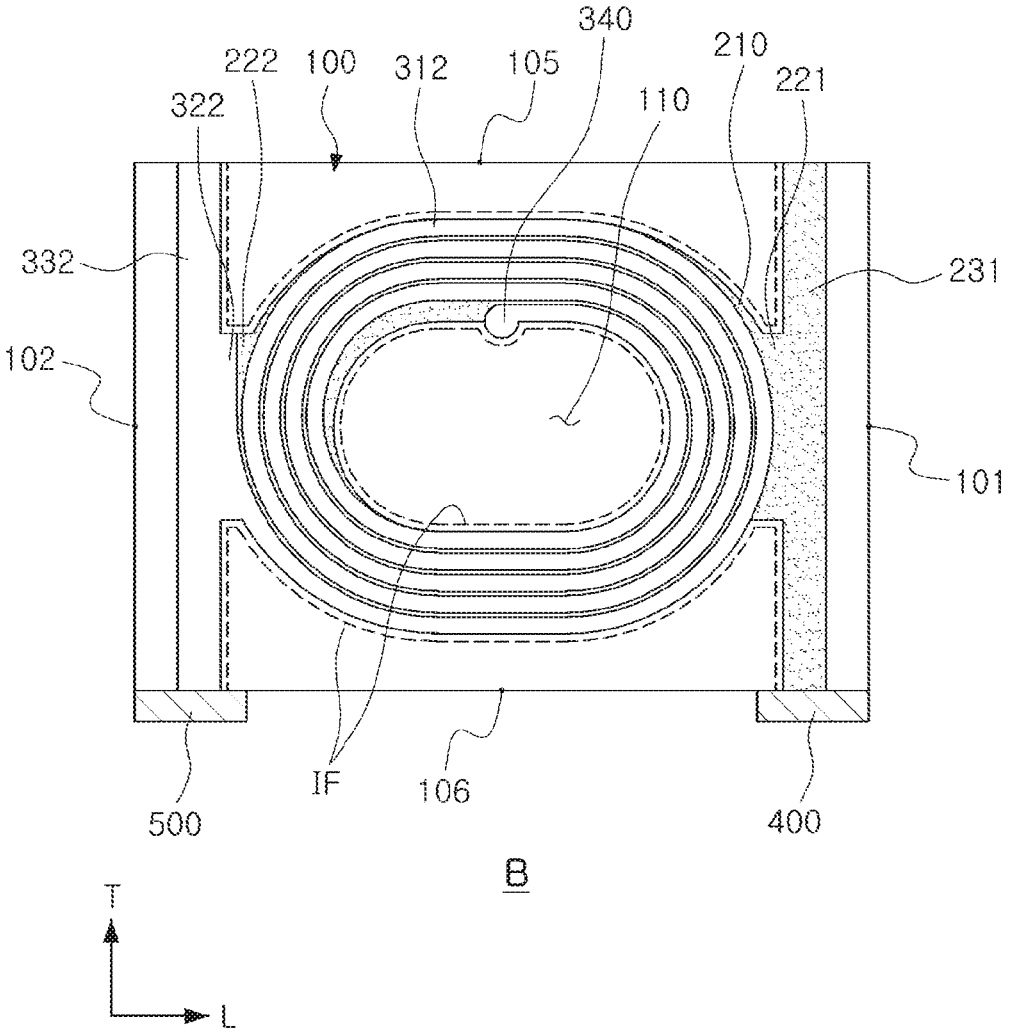
FIG. 5 is a diagram illustrating the coil component illustrated in FIG. 4, viewed in direction B.

FIG. 4 is a diagram illustrating a coil component according to another exemplary embodiment. FIG. 5 is a diagram illustrating the coil component illustrated in FIG. 4, viewed in direction B.

Referring to FIGS. 1, 2, 4, and 5, in a coil component 2000 in the exemplary embodiment, positions of lead-out portions 331 and 332 may be different from those of the coil component 1000 described in the aforementioned exemplary embodiment. Accordingly, in the exemplary embodiment, only a shape of the coil portion 300, a difference from the aforementioned exemplary embodiment, will be described. The descriptions of the other elements are the same as in the aforementioned exemplary embodiment.

Referring to FIGS. 4 and 5, lead-out portions 331 and 332 of a coil portion 300 in the example embodiment may be only exposed to one surface 106 and the other surface 105 of the body 100 among external surfaces 101, 102, 103, 104, 105, and 106 of the body 100. Only both ends portions of the lead-out portions 331 and 332 may be exposed to the one surface 106 and the other surface 105 of the body 100, respectively, and the other surfaces may be buried in the body 100 and may not be externally exposed. As an example, as illustrated in FIG. 5, aside surface of the second lead-out portion 332 connecting one end and the other end of the second lead-out portion 332 to each other may be spaced apart from the second surface 102 of the body 100 and may not be externally exposed. In the exemplary embodiment, as side surfaces of the lead-out portions 331 and 332 are not exposed to the first to fourth surfaces 101, 102, 103, and 104 of the body 100, electrical shorts (short-circuit) with the other electronic components adjacently mounted may be prevented. Also, as the side surfaces of the lead-out portions 331 and 332 are not exposed to the first to fourth surfaces 101, 102, 103, and 104 of the body 100, bonding force between the coil portion 300 and the body 100 may improve.

According to the aforementioned exemplary embodiments, a coil component which may reduce a mounting surface while maintaining volumes of a magnetic material and a coil portion may be provided.

Also, a coil component having improved heat dissipation properties may be provided.

While the exemplary embodiments have been shown and described above, it will be apparent to those skilled in the art that modifications and variations could be made without departing from the scope of the present invention as defined by the appended claims.

What is claimed is:

1. A coil component, comprising:

a body having both end surfaces opposing each other in a length direction;

a support substrate disposed in the body;

a coil portion disposed on the support substrate in a width direction of the body, and including first and second lead-out portions each exposed to a first surface and a second surface of the body opposing each other in a thickness direction of the body; and first and second external electrodes disposed on the first surface of the body, spaced apart from each other, and respectively connected to one ends of the first and second lead-out portions exposed to the first surface of the body, wherein a thickness of the body in the thickness direction is greater than a width of the body in the width direction.

2. The coil component of claim 1, wherein each of the first and second lead-out portions penetrates the body in the thickness direction of the body.

3. The coil component of claim 1, wherein the body has a core penetrating the support substrate and the coil portion in a direction parallel to the first surface of the body, and wherein the coil portion includes at least one turn with reference to the core on the support substrate.

4. The coil component of claim 1, wherein the first and second lead-out portions are respectively exposed to the both end surfaces of the body.

5. The coil component of claim 1, wherein each of the first and second lead-out portions is exposed only to the first surface and the second surface of the body among external surfaces of the body.

6. The coil component of claim 1, wherein the first and second external electrodes extend from the first surface of the body onto the both end surfaces of the body, respectively.

7. The coil component of claim 6, wherein the first and second external electrodes further extend from the both end surfaces, respectively, onto the second surface of the body.

8. The coil component of claim 1, further comprising first and second heat dissipation portions disposed on the second surface of the body, spaced apart from each other, wherein the first and second heat dissipation portions are respectively in contact with other ends of the first and second lead-out portions exposed to the second surface of the body.

9. The coil component of claim 1, wherein the coil portion includes first and second coil patterns disposed on both surfaces of the support substrate, and first and second connection patterns connecting the first and second coil patterns to the first and second lead-out portions, respectively, and wherein each of the first and second connection patterns includes a bonding reinforcement groove penetrating a respective one of the first and second connection patterns.

10. The coil component of claim 9, wherein each of the first and second connection patterns includes a plurality of connection patterns spaced apart from each other by the respective bonding reinforcement groove.

11. A coil component, comprising:

a body having first and second surfaces opposing each other in a thickness direction, third and fourth surfaces opposing each other in a width direction and connecting the first and second surfaces to each other, and fifth and sixth surfaces opposing each other in a length direction and connecting the first and second surfaces to each other and the third and fourth surfaces to each other;

a support substrate disposed in the body;

a coil portion disposed on the support substrate in the width direction, and including first and second lead-out portions each extending in an opposite manner in the length direction, wherein each of the first and second lead-out portions includes two ends respectively extending in an opposite manner in the thickness direction to be exposed to the first and second surfaces, respectively; and first and second external electrodes disposed on the first surface of the body, spaced apart from each other, and respectively connected to one ends of the first and second lead-out portions exposed to the first surface of the body.

12. The coil component of claim 11, wherein the each of the first and second lead-out portions penetrates the body in the thickness direction.

13. The coil component of claim 11, wherein the body has a core penetrating the support substrate and the coil portion in the width direction, and wherein the coil portion includes at least one turn with reference to the core on the support substrate.

14. The coil component of claim 11, wherein the first and second lead-out portions are respectively exposed to the first and second surfaces of the body.

15. The coil component of claim 11, wherein the each of the first and second lead-out portions is exposed only to the first and second surfaces of the body among external surfaces of the body.

16. The coil component of claim 11, wherein the first and second external electrodes extend from the first surface of the body onto the first and second surfaces of the body, respectively.

17. The coil component of claim 16, wherein the first and second external electrodes further extend from the first and second surfaces, respectively, onto the second surface of the body.

18. The coil component of claim 11, further comprising first and second heat dissipation portions disposed on the second surface of the body, spaced apart from each other, wherein the first and second heat dissipation portions are respectively in contact with other ends of the first and second lead-out portions exposed to the second surface of the body.

19. The coil component of claim 11, wherein the coil portion includes first and second coil patterns disposed on both surfaces of the support substrate in the width direction, and first and second connection patterns connecting the first and second coil patterns to the first and second lead-out portions, respectively, and wherein each of the first and second connection patterns includes a bonding reinforcement groove penetrating a respective one of the first and second connection patterns.

20. The coil component of claim 19, wherein each of the first and second connection patterns includes a plurality of connection patterns spaced apart from each other by the respective bonding reinforcement groove.

* * * * *